US009953495B2

(12) United States Patent
Rothrauff, Jr.

(10) Patent No.: US 9,953,495 B2
(45) Date of Patent: Apr. 24, 2018

(54) ACTIVE AUTOMATED ANTI-BOARDING DEVICE AND MARITIME ASSET SECURITY SYSTEM

(71) Applicant: Trident Group, Inc., Virginia Beach, VA (US)

(72) Inventor: Thomas B. Rothrauff, Jr., Virginia Beach, VA (US)

(73) Assignee: TRIDENT GROUP, INC., Virginia Beach, VA (US)

( * ) Notice: Subject to any disclaimer, the term of this patent is extended or adjusted under 35 U.S.C. 154(b) by 0 days.

(21) Appl. No.: 14/359,257

(22) PCT Filed: Nov. 28, 2012

(86) PCT No.: PCT/US2012/066794
§ 371 (c)(1),
(2) Date: May 19, 2014

(87) PCT Pub. No.: WO2013/082115
PCT Pub. Date: Jun. 6, 2013

(65) Prior Publication Data

US 2014/0266809 A1 Sep. 18, 2014

Related U.S. Application Data

(60) Provisional application No. 61/564,434, filed on Nov. 29, 2011.

(51) Int. Cl.
*G08B 23/00* (2006.01)
*G08B 13/00* (2006.01)
(Continued)

(52) U.S. Cl.
CPC ..... *G08B 13/00* (2013.01); *B63G 13/00* (2013.01); *F41H 13/005* (2013.01);
(Continued)

(58) Field of Classification Search
CPC . A01D 1/00; H04B 1/02; G08B 13/22; G08B 13/00; G08B 13/08; G08B 13/02
(Continued)

(56) References Cited

U.S. PATENT DOCUMENTS 4,518,953 A * 5/1985 Hunter ..... G08B 13/122 256/10
4,760,381 A 7/1988 Haag
(Continued)

FOREIGN PATENT DOCUMENTS

KR 1020100065543 A 6/2010
KR 1020100119405 A 9/2010
(Continued)

OTHER PUBLICATIONS

HPV Technologies, Inc., "Maritime Security a look at Non-Lethal Protection", http://www.getmad.com/maritime, Nov. 28, 2011, 2 pages.
(Continued)

*Primary Examiner* — Jack K Wang
(74) *Attorney, Agent, or Firm* — Greer, Burns & Crain, Ltd.

(57) ABSTRACT

An active automated anti-boarding device for a maritime asset security system includes a housing for mounting the device on a maritime asset. The deterrence device includes visual and sound deterrence emitters within said mount to disperse a directional fan pattern of sight and visual deterrence response outward from the housing to unauthorized boarders. An active automated anti-boarding maritime asset security system includes detection devices configured to mount to maritime asset, the detection devices each including emitters and receivers for generating and detection beams that form a virtual fence to form a detection network on a portion or around an entire maritime asset. Deterrence
(Continued)

devices responsive to the interruption of the spaced apart detection beams produce a deterrent response that is non lethal. The deterrence response can be a law enforcement level of deterrence, it can induce discomfort and/or disorientation to deter unauthorized boarders. The deterrence response can be strong enough to cause physical pain in an authorized boarder.

3 Claims, 7 Drawing Sheets

(51) Int. Cl.

| | |
|---|---|
| ***B63G 13/00*** | (2006.01) |
| ***F41H 13/00*** | (2006.01) |
| ***G08B 13/183*** | (2006.01) |
| *G08B 13/18* | (2006.01) |
| *G08B 3/10* | (2006.01) |
| *G08B 3/00* | (2006.01) |

(52) U.S. Cl.
CPC ..... *F41H 13/0081* (2013.01); *F41H 13/0087* (2013.01); *G08B 13/183* (2013.01)

(58) Field of Classification Search
USPC ..... 340/984, 541; 56/1; 367/139
See application file for complete search history.

(56) References Cited

U.S. PATENT DOCUMENTS 4,931,769 A * 6/1990 Phillips ..... G08B 25/008 340/5.32
5,214,411 A * 5/1993 Herbruck ..... A01M 29/18 119/174
6,281,790 B1 * 8/2001 Kimmel ..... G08B 13/19608 340/506
6,367,943 B1 * 4/2002 Tocci ..... F41H 5/08 362/103
6,388,949 B1 * 5/2002 Lenhardt ..... A01K 79/02 116/22 A
6,575,597 B1 * 6/2003 Cramer ..... F21V 33/0064 116/22 A
7,183,907 B2 * 2/2007 Simon ..... G08B 13/19682 340/10.1
2003/0058105 A1 3/2003 Wustefeld et al.
2003/0058740 A1 * 3/2003 Jincks ..... A01M 29/16 367/139
2003/0071735 A1 * 4/2003 Hanson ..... A01M 29/16 340/573.2
2004/0174256 A1 * 9/2004 Hershkovitz ..... G08B 25/008 340/506
2004/0233414 A1 * 11/2004 Jamieson ..... G01S 7/4802 356/4.01
2005/0102988 A1 * 5/2005 Pinton ..... A01M 29/10 56/1
2006/0176193 A1 * 8/2006 Wraight ..... B63B 49/00 340/984
2007/0074467 A1 * 4/2007 Zecher ..... A01M 29/32 52/101
2008/0157965 A1 * 7/2008 Shahar ..... G01V 8/20 340/556
2008/0216699 A1 * 9/2008 McAleer ..... F42B 12/36 102/367
2008/0265144 A1 * 10/2008 Shaked ..... G01V 8/14 250/221
2009/0289790 A1 * 11/2009 Issokson ..... G08B 13/189 340/552
2010/0293831 A1 * 11/2010 Hreinsson ..... A01K 75/02 43/4.5
2011/0006897 A1 * 1/2011 Micko ..... G08B 13/191 340/565
2011/0143613 A1 * 6/2011 Wills ..... B63B 35/85 441/74
2011/0187543 A1 * 8/2011 Russo ..... G08B 17/10 340/628
2011/0227733 A1 * 9/2011 Kelly ..... E01B 17/00 340/541
2013/0249218 A1 * 9/2013 Vassilev ..... A01M 29/16 290/55

FOREIGN PATENT DOCUMENTS

KR 1020110092555 A 8/2011
WO WO2004009439 A1 1/2004

OTHER PUBLICATIONS

HPV Technologies, Inc., "MAD Speaker Speficiations", http://www.getmad.com/maritime, Nov. 28, 2011, 2 pages.

* cited by examiner

ACTIVE AUTOMATED ANTI-BOARDING DEVICE AND MARITIME ASSET SECURITY SYSTEM

The application claims priority under 35 U.S.C. §119 from prior provisional application Ser. No. 61/564,434, which was filed on Nov. 29, 2011.

FIELD

A field of the invention is maritime asset boarding security. A preferred application of the invention is an anti-piracy system on an ocean going sea vessel. Another application is an anti-boarding system for gas and oil platforms.

BACKGROUND

The International Maritime Bureau has studied maritime piracy and has noted substantial increases in acts of piracy from 2006 through 2011. While 2012 has exhibited a decrease in the number of acts, the risks and costs remain intolerable and a satisfactory solution remains elusive. The cost of piracy in terms of goods stolen, insurance premiums, freight re-routings, security teams, ship damage and other factors is difficult to measure exactly. However, the International Maritime Bureau estimated that Somali piracy cost the world $7 billion in 2011.

Ransom demands pose both a threat to human life and a direct and expensive cost. According to International Maritime Bureau, the number of incidents in 2012 was down 32 percent through July 2012 compared to 2011. Reuters reported that pirates are exhibiting higher levels of organization. Reuters obtained a "pirate packet" that was presented to an owner of a hijacked oil tanker from a criminal organization naming itself the Pirate Action Group. The packet included a form memo with demands for compensation to obtain return of vessel and crew. According to Reuters, as of early August 2012, armed Somali pirates hold more than 170 hostages, according to the IMB, and were responsible for 35 deaths in 2011 alone.

Reasons for the reduced number of piracy acts in 2012 are not clear. Some credit the expensive military intervention via patrols. Various countries have patrolled the Somali coast. However, the effectiveness of this strategy is not accepted by all. Captured pirates are often disarmed and released back to Somalia. Countries that have captured Somali pirates have not put them on trial. In response to naval patrols, pirates are also moving further from shore. Patrolling the Indian Ocean is a much less practical task. In any event, military patrols are very expensive and also raise the specter of geopolitical conflicts.

Nonetheless, the importance of maintaining the openness of strategic shipping lanes is widely accepted. Shipping lanes are critical to the worldwide economy. Finished goods and material resources, including oil, are routinely transported via ocean going ships. The interruption of strategic routes can have significant negative economic consequences in addition to the more readily measured loss to a given shipment. There is also a threat to human life, as piracy threatens the crew manning ships.

The threat also extends to other maritime assets. Large, medium and small vessels carry passengers upon the world's seas and are also at risk. The risk to a pleasure vessel includes the risk of theft, hostage taking, and human life. World energy companies have oil exploratory and pumping rigs situated around the world in a maritime setting. These assets are called gas and oil platforms. These platforms are under constant threat of attack, vandalism, and destruction in accordance with various geo-political motives.

In view of the risks, there is interest in protecting maritime assets. One option is armed guards. However, armed guards are not favored for many reasons. Crews are not skilled in the use of weapons and are not likely to be effective in their use. Adding highly trained personnel adds significant costs, and many cargo and passenger vessels have limited quarters to accommodate additional crew. In addition, many countries have strict customs laws that are extremely unforgiving in reference to the presence of weapons aboard vessels entering their territorial waters. Gas and oil platform working environments do not allow sufficient space for guards to be placed aboard the asset. Weapons are highly discouraged on gas and oil platforms to limit the risk of spark in a petroleum fume rich environment.

Maritime assets have also been equipped with monitoring systems to alert crews and allow crews to take other preventative measures. Crew activated prevent measures include a variety of devices, such as water hoses and non-lethal electric fencing. Many of these systems require crew involvement after being alerted to a threat by a monitoring system, and can also be defeated by determined assailants. In addition, many common land-based security systems are ineffective on maritime assets as sound and light based detection systems are complicated by the wind and water conditions that a sea vessel is subjected to when at sea.

Examples of systems requiring substantial crew involvement include a razor wire and smoke anti-boarding system developed by a company called Vessel Protection Systems. Canisters are hooked to the vessel's perimeter and each of the canister jettison 20 meters of razor wires which is swept aft by the speed of the ship to form a barrier, stretching from the main deck to the waterline. This large canisters of this system must be installed by crew when at sea and removed when in port, limiting the utility of the system. The reliance on vessel movement for deployment also limits the effectiveness of the system. Vessel Protection systems provides a separate solution for situations when vessels are at anchor or port. This solution is called the Climb Stopper. The Climb Stopper also is crew activated but does not rely on vessel's speed through the water for its effectiveness. The physical configuration is similar, but the uses large tanks of Oleoresin Capsicum (pepper spray) that each required a pair of electric pumps. The tanks cooperate with pipes that are permanently installed along the outside of the bulwarks at main deck level. When activated, the Climb Stoppers supply an overlapping spray to deter boarding.

One company, HPV Technologies has deployed a long throw planar magnetic speaker system referred to as the "MAD" speaker system. The device is a long-range audio device and magnetic acoustic device. It includes a long range communication mode in addition to a deterrence mode. After establishing intent with a detected vessel, crew can activate the deterrence mode of the device and direct it at potential intruders to produce a piercing tone that can irritate or disorientate the potential intruders. This system relies upon the crew for its activation and use. Some versions can be remotely controlled from the bridge to pan and tilt with the assistance of night vision cameras and lasers. It has been used in practice to deter pirates. However, like prior systems it assumes a permanent deck watch or other monitoring system.

Problems with crew involvement for activation include the fact that such systems are designed to activate once the intruder has already crossed the rail of the vessel—requiring the crew to play "catch up" to force protection. This scenario presents significant danger, as compliance is the only recourse for the crew's survival. In addition, the effectiveness of such systems is limited by the ability of the crew to detect threats. To make such systems effective, it is typical to employ additional, specialized crew. Attention must be devoted to radars, increased deck watches, and possibly embarked security teams.

SUMMARY OF THE INVENTION

An active automated anti-boarding device for a maritime asset security system includes a housing for mounting the device on a maritime asset. The deterrence device includes visual and sound deterrence emitters within said mount to disperse a directional fan pattern of sight and visual deterrence response outward from the housing to unauthorized boarders. An active automated anti-boarding maritime asset security system includes detection devices configured to mount to the maritime asset, the detection devices each including emitters and receivers for generating and detection beams that form a virtual fence to form a detection network on a portion or around an entire maritime asset.

In preferred embodiments systems, the detection network is "zoned" so that any zone may be shut down if work needs to be accomplished across that zone area yet allows for the remainder of the system to remain energized protecting the remainder of the maritime asset. Deterrence devices responsive to the interruption of the spaced apart detection beams produce a deterrent response that is non lethal. The deterrence response can be a law enforcement level of deterrence, it can induce discomfort and/or disorientation to deter unauthorized boarders. The deterrence response can be strong enough to cause physical pain in an authorized boarder. Preferred systems of the invention include a monitoring and control station, which can be positioned on the bridge of a sea vessel, or in the control center of a gas and oil platform. The monitoring and control station preferably includes a monitor with a graphical user and touchscreen interference that illustrates system status, where a breach is occurring, and other important information. The control station also permits the system to be set-up, such as by zoning.

DETAILED DESCRIPTION OF THE PREFERRED EMBODIMENTS

Figure 1A:
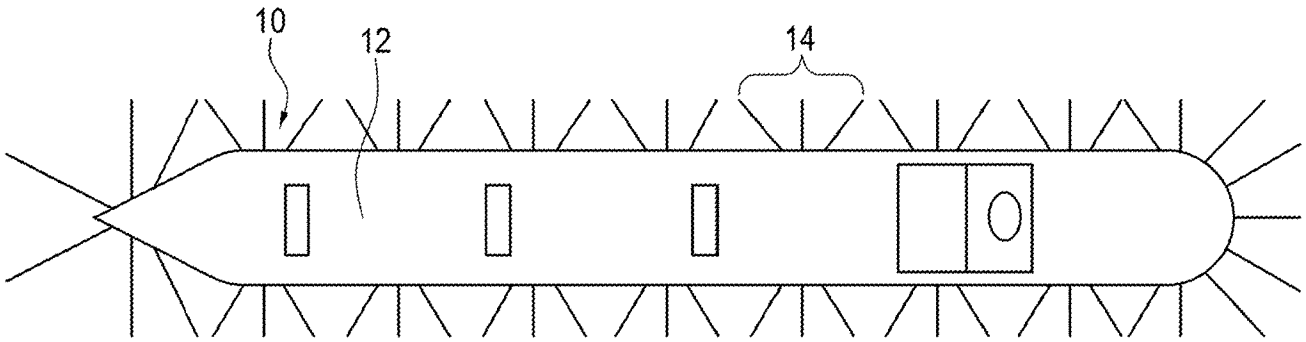
FIGS. 1A and 1B are a schematic top and side view diagrams of a sea vessel outfitted a sea-vessel security system according to an embodiment of the invention.

A preferred system of the invention provides for reliable detection, crew alert and automatic deterrence of unauthorized attempted boarders. The preferred system is robust, difficult to defeat, discriminating in its detection and effective in automatically provided deterrence of unauthorized boarders. A preferred system of the invention includes a number of detection devices that can preferably be disposed to completely encircle a maritime asset above the water line, or at least a portion of the asset determined to be at risk. The detection devices in the preferred embodiment are structured as fence pods. The fence pods include alternating emitters and receivers, which propagate multiple spaced apart light beams to form a detection network.

The detection pods and deterrence pods are preferably hardwired into the electrical system of a maritime asset. When used on a ship, for example, the detection pods are preferably hardwired into the ship's electrical system and bridge, and are mounted at a location that will necessarily encompass hooks and/or ladders associated with an attempted unauthorized entry. Interruption of the beams, or the failure of one of the pods triggers notification and automatic response of deterrence devices.

The deterrence response preferably includes a law enforcement level of strobe, multiple spectrum lasers (preferably emitting all of red, green and blue spectrums), and high amplitude sound. The sound is preferably produced by air compressor horns, or by another type of device that produces an intolerable deterrence sound. The deterrence pattern, once triggered, covers the side of maritime asset in an overlapping fan pattern that creates a highly effective deterrent.

The system also preferably includes a bridge monitoring and control system, preferably including a graphical touchscreen monitor. The monitoring and control system can be used to selectively activated the anti-boarding system for port and sea going use or to selectively de-energize zones so that maritime asset operations may be conducted without initiating the alert system The system works whether crew are asleep or awake, day and night. It protects a vessel at sea, in port or at anchorage and gas and oil platforms in every configuration available. The effects of the system are directed towards the boarders with no impact on the crew or the workload schedule necessary aboard the maritime asset.

A system of the invention uses detection and deterrence devices. Detection and deterrence devices can be implemented, for example, in a single pod or one or more separate pods (mounted in the same or multiple housing. Each detection pod in a system is configured to be mounted to a maritime asset, and preferably hardwired into the maritime asset system, and to communicate in a network of additional pod devices via emitting and receiving light beams. Each deterrence pod preferably includes a multi-sensory response that creates discomfort and/or disorientation. In preferred embodiments, each deterrence pod provides a strobe with multiple spectrum lasers (preferably emitting all of red, green and blue spectrums), in addition to high amplitude law-enforcement directional sound.

Systems of invention are capable of deterring unwanted boarders and can be applied in a system to vessels and other maritime assets of unlimited size. A system of the invention works against boarders but does not affect crew, as its deterrence response is directional and is also automatic, permitting crew to conduct their normal functions or be at rest during an event. A preferred system of the invention can be zoned and can be operated with individual zones or all zones together to completely or partially surround a maritime asset. The system can operate underway, pier side or at anchorage. The system preferably operates in three modes: Active, Passive and Emergency. The system preferably has a scalable response, and can be used in the private and public sector as well as on government vessels. A system can alert the crew to a boarding attempt with visual alarms, and permit crew intervention to disable a response once a threat has ceased.

Systems of the invention can be retrofitted onto existing maritime assets. In addition, systems of the invention can be incorporated into new maritime assets when the maritime assets are manufactured.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale.

Figure 1B:
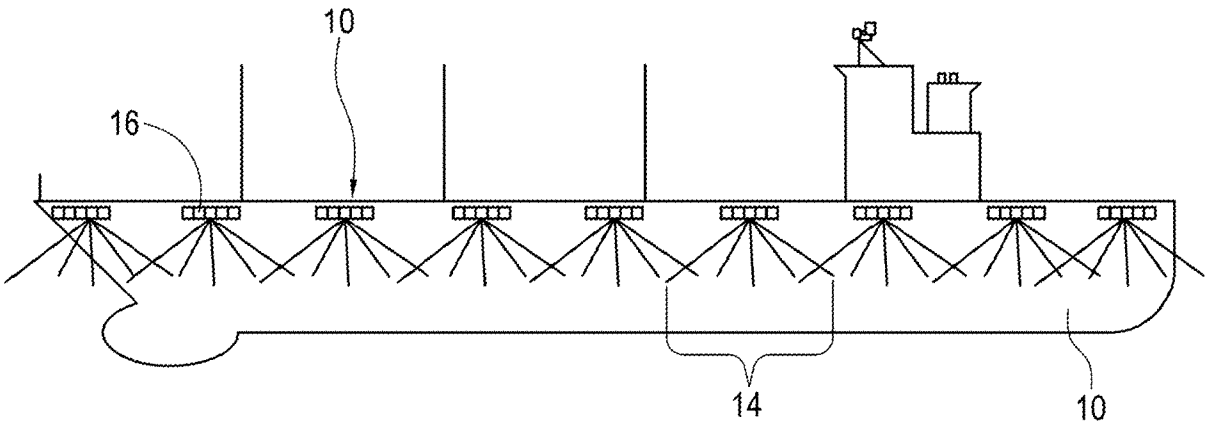

FIGS. 1A-1D show a preferred embodiment anti-boarding system 10 of the invention mounted on a sea vessel 12. The sea vessel 12 can be, for example, an oil tanker, cargo container, or a large commercial or private passenger ship. FIGS. 1A and 1B illustrate the system 10, providing an overlapping fan pattern multi-sensory and intense deterrence response 14. The deterrence response is non-lethal, but creates discomfort and/or disorientation to deter unauthorized boarders. The levels of sound and visual stimuli can be high enough to cause physical pain in an unauthorized boarder that encounters the deterrence response. In preferred embodiments, the multi-sensory deterrence response includes extraordinary levels of sound and visual deterrence that makes boarding very difficult to impossible for ordinary humans. The deterrence response 14 is provided from deterrence pods 16 (which can also be combined detection/deterrence pods), and the response does not exhaust any physical resources of the deterrence pods. This allows the system 10 to be reset and used over and over again without replacement or replenishment of the deterrence pods. This is advantageous compared to some commercial systems that deploy, for example, razor wire or other exhaustible deterrents. Such systems can be used once and then must be replaced. In addition, such systems tend to be very bulky, whereas deterrence pods of the invention can also be compact.

Figure 1C:
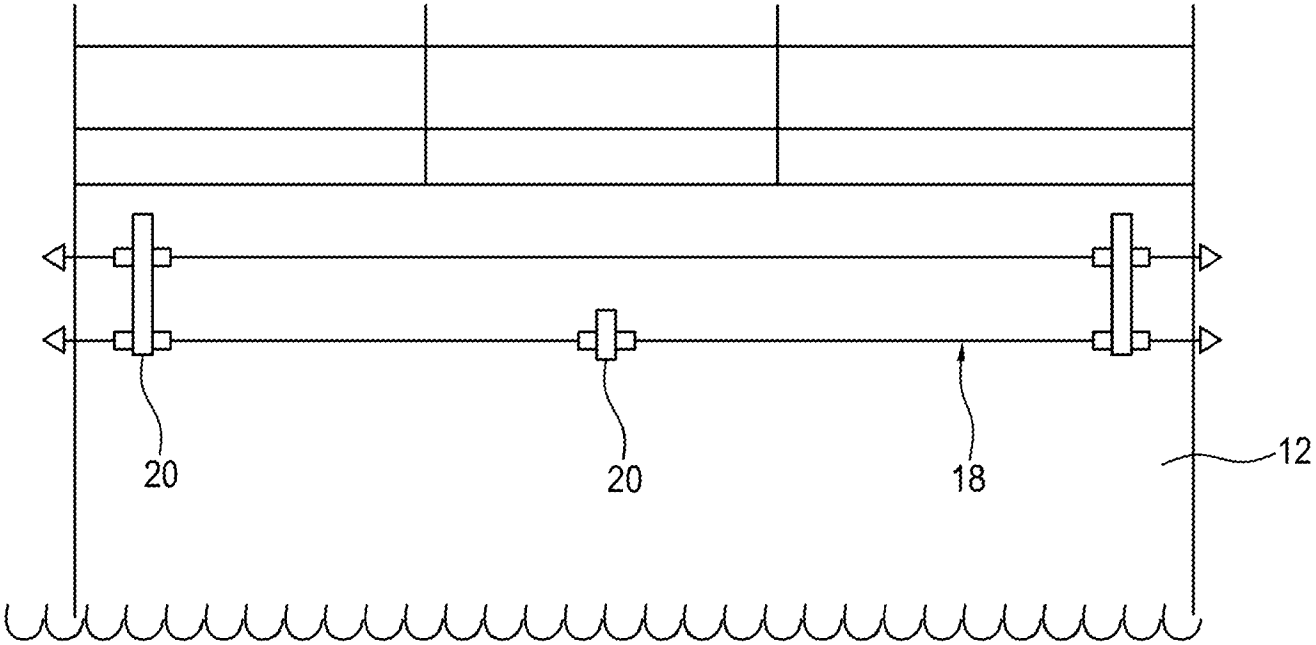
FIGS. 1C and 1D is a schematic partial front view and side view diagram of a preferred mounting for detection virtual fence devices and boarding deterrence devices used in the sea-vessel security system of FIG. 1.
Figure 1D:
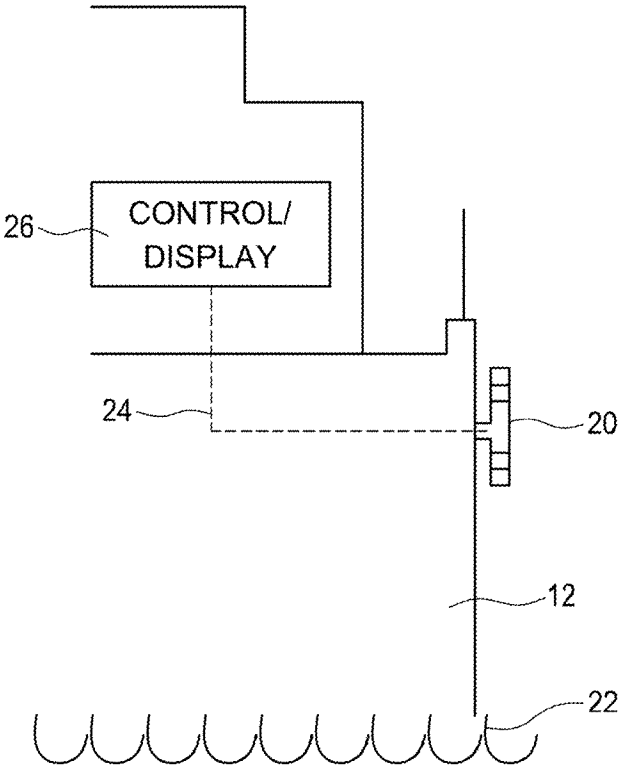

FIGS. 1C and 1D are partial diagrams that illustrate a virtual fence 18 created by detection fence pod devices 20. The fence pod devices are mounted at a location that is distant enough from the waterline 22 to avoid sea conditions from triggering a detection event. Each detection fence pod device includes beam generation and detection capability so that interruptions of the virtual fence 18 between any two devices can be detected to trigger the deterrence response 14. One or both the deterrence response 14 and the detection fence 18 can be zoned. The devices are preferably hardwired 24 directly into the systems of the vessel 12 and also provided power from the systems of the vessel. This is one power supply to the system fence pods and deterrence pods. The system 10 is preferably also connected to secondary source such as a battery backup, and a tertiary source comes such as solar power storing energy into system capacitors, a hack-up gas generator, or a generator that converts power from a water turbine associated with the maritime asset.

The detection and deterrence devices can be activated, controlled, and monitored via a standard display and control module 26 on the bridge or in a security area of the maritime asset 12.

The system 10 preferably includes fence 20 and deterrence pods 16 mounted to encompass the entire perimeter of a maritime asset and provide a pattern of deterrence response 14 that overlaps, as shown in FIGS. 1A and 1B.

Figure 2:
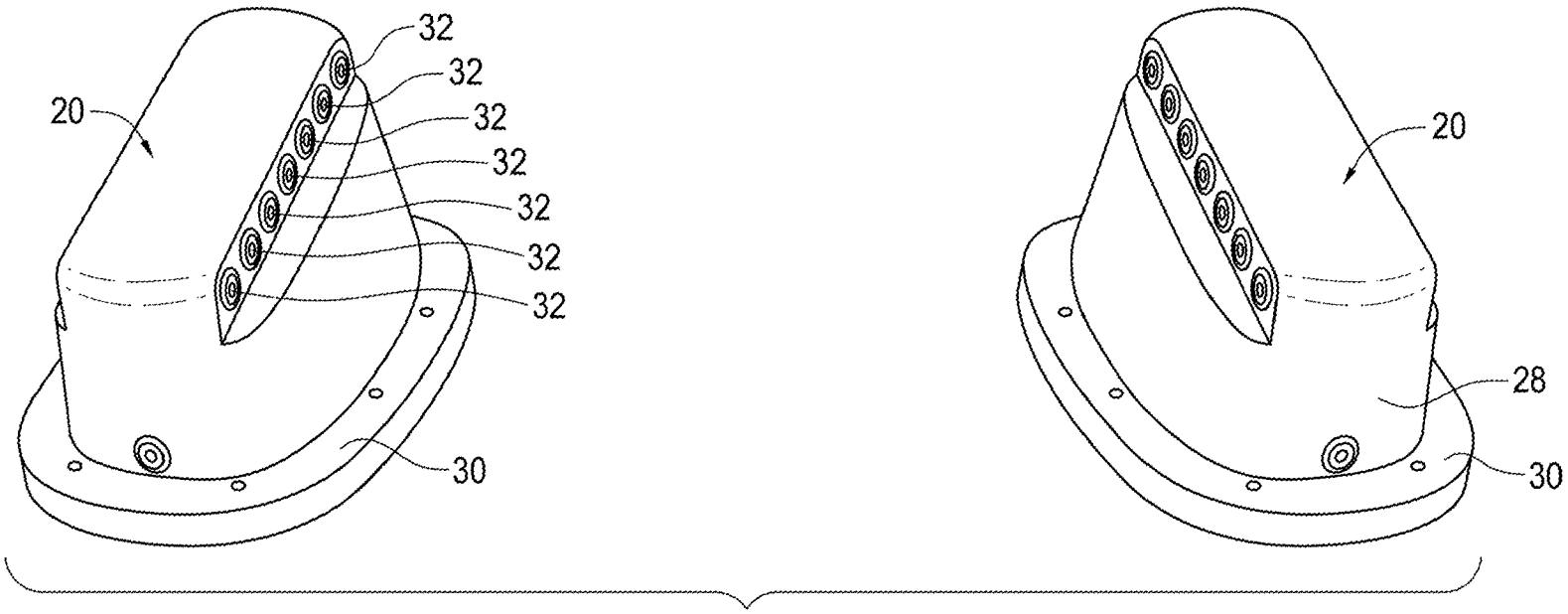
FIG. 2 illustrates a preferred embodiment active automated anti-boarding detection device virtual fence pair used in the sea-vessel security system of FIG. 1.

FIG. 2 shows a pair of detection fence pods 20. Housings 28 of the detection fence pods include a mounting base 30 the permits mounting on the vessel 12 such that the fence will be a sufficient distance from the base of the asset 12 to permit direct line of sight/detection between the modules but small enough to avoid the possibility that an unauthorized boarder could avoid the virtual fence 18 that the detection fence pods 20 create. The housings 28 are made of seaworthy materials that will not corrode. The base 30 includes a suitable vessel mounting structure, e.g., bolt or rivet holes, or a flat surface for adhesive attachment. Another option is attachment via permanent magnets or permanent mountings via weld or mounting bolts. A preferred system includes fence pods for monitoring and detection and deterrence pods for response.

The detection fence pods 20 in FIG. 2 include a spaced apart group of 7 light emitters and detectors 32. A light emitters and detectors 32 are arranged at an angle so that different ones of 7 beams that will form a virtual fence with beams that are at different distances from the surface of an asset to which the detection fence pods 20 are attached. As seen in FIG. 2, the detection fence pods are also preferably installed on a maritime asset form more than one virtual fence line. With detection fence pods 20 properly arranged on a maritime asset, unauthorized boarding with the aid of climbing tools or any pre-installed asset ladders. Accordingly, in many instances, detection fence pods should encompass an area of a maritime asset that is likely to provide an attachment point for boarding aids or a path through which unauthorized boarder must traverse.

The deterrence pods 16 are activated by the break of light beam, e.g., an infrared (IR) beam, from the fence pods 20. The fence pods preferably alternate IR transmission and reception devices provide a virtual fence at a distance from the skin of the maritime asset 12 that will necessarily be traversed by a ladder or a hook of intruders, typically at least approximately six (6) inches and no more than about 31 inches out from the skin of the maritime asset, though the exact distance will depend upon the geometry of the maritime asset (asset size depends on distance placed from the skin). The IR beam is electrically connected to the triple horn plates. When the beam is broken, a signal is sent to some or all of the deterrence device pods 16 to activate the deterrence response 14.

Figure 3:
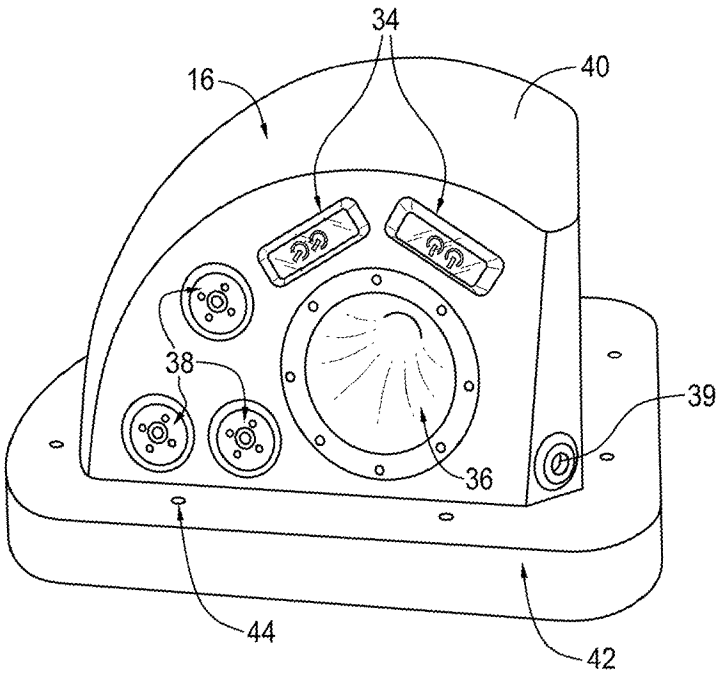
FIG. 3 illustrates a preferred embodiment active automated anti-boarding deterrence device used in the sea-vessel security system of FIG. 1.

FIG. 3 shows a deterrence pod 16. The deterrence pod 16 houses and includes strobe outputs 34 multiple horn outputs 36 (one is shown in the view of FIG. 3, while another would be to the right of the face shown in FIG. 3), and outputs for laser 38. In preferred embodiments, two or three faces of the pod 16 include outputs. The outputs are arranged so that the deterrence response is emitted in a directional pattern as shown in FIGS. 1A and 1B. The pod 16 also includes drain vents 39 in a housing 40 that is similar to the housing 28 for the detection fence pods is used for the deterrence pod. The housing 40 includes a base 42 having a number of through holes 44 for attachment via rivet or screws to a vessel.

The preferred deterrence pod device 16 groups several functions that combine to disorient people. When properly tied together; these functions create a shield around the gunwale of the vessel or base of maritime asset 12. The system is activated by someone attempting to board the maritime asset without permission (system is energized). The deterrence response pattern 14 provides a wall of defense that is intolerable and disorienting to unauthorized boarders. A combination of sound, strobe and laser is preferred and provided by the deterrence pod device of FIG. 2.

The horn plate outputs 36 direct output from one sound producing horn within the housing 40 and is pointed outward and downward towards the waterline when mounted on a vessel as shown in FIG. 1B. The horn output 36 is positioned so that the horns emit sound that crisscrosses with output of adjacent deterrent device pods 16 to cover large waterline areas. The sound emitted is of a physically disturbing decibel and frequency level. The intent is that the resultant noise level is so uncomfortable, startling, disorienting, and/or painful to those trying to board that it will, in fact, repel them. The strobe output and laser output also overlap and create disorientating visual effects that can induce a loss of balance, equilibrium, sense of direction, and sense of distance to objects near and far. In preferred embodiments, the laser outputs 38 include green, red and blue lasers and the strobe emitter 34 includes a law enforcement grade of disabling strobe.

Figure 4:
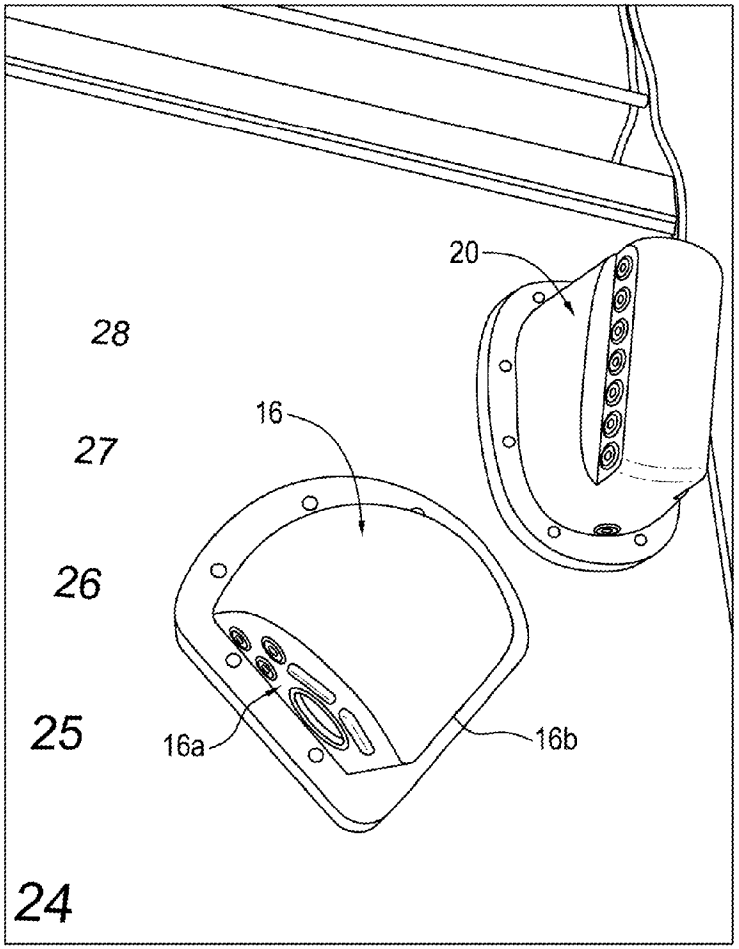
FIG. 4 illustrates an example installation for a detection virtual fence devices and a boarding deterrence device of a preferred embodiment system of the invention.

FIG. 4 shows an example installation of a deterrence pod 16 and a fence pod 20 on the hull of a ship. The deterrence pod includes two identical faces 16*a* and 16*b* with the strobe, laser and horn outputs shown in detail in FIG. 3 The faces 16*a* and 16*b* are angled with respect to each other such that their deterrence outputs will fan down the hull in a divergent pattern. The fence pod is mounted near a gunwale of a the ship to create a virtual fence immediately below the gunwale where unauthorized boarders would seek to attach boarding devices.

The system 10 is a "stand alone" protection system. There is no human monitoring necessary. This permits for a Boarding Alert while underway, at anchorage, or pier side on vessels and in any profile for gas and oil platforms, 24-hours a day. The system 10 can be "zoned" to allow for access to the maritime asset on de-energized sides. The zoning can be separated into any configuration required. If the vessel were pier side port, then the starboard side, plus the bow and stern, would be the active zones. Conversely, the port side would be the operational side given a starboard side mooring position. On gas and oil platforms, any side may be desensitized for entry or operations.

Figure 5:
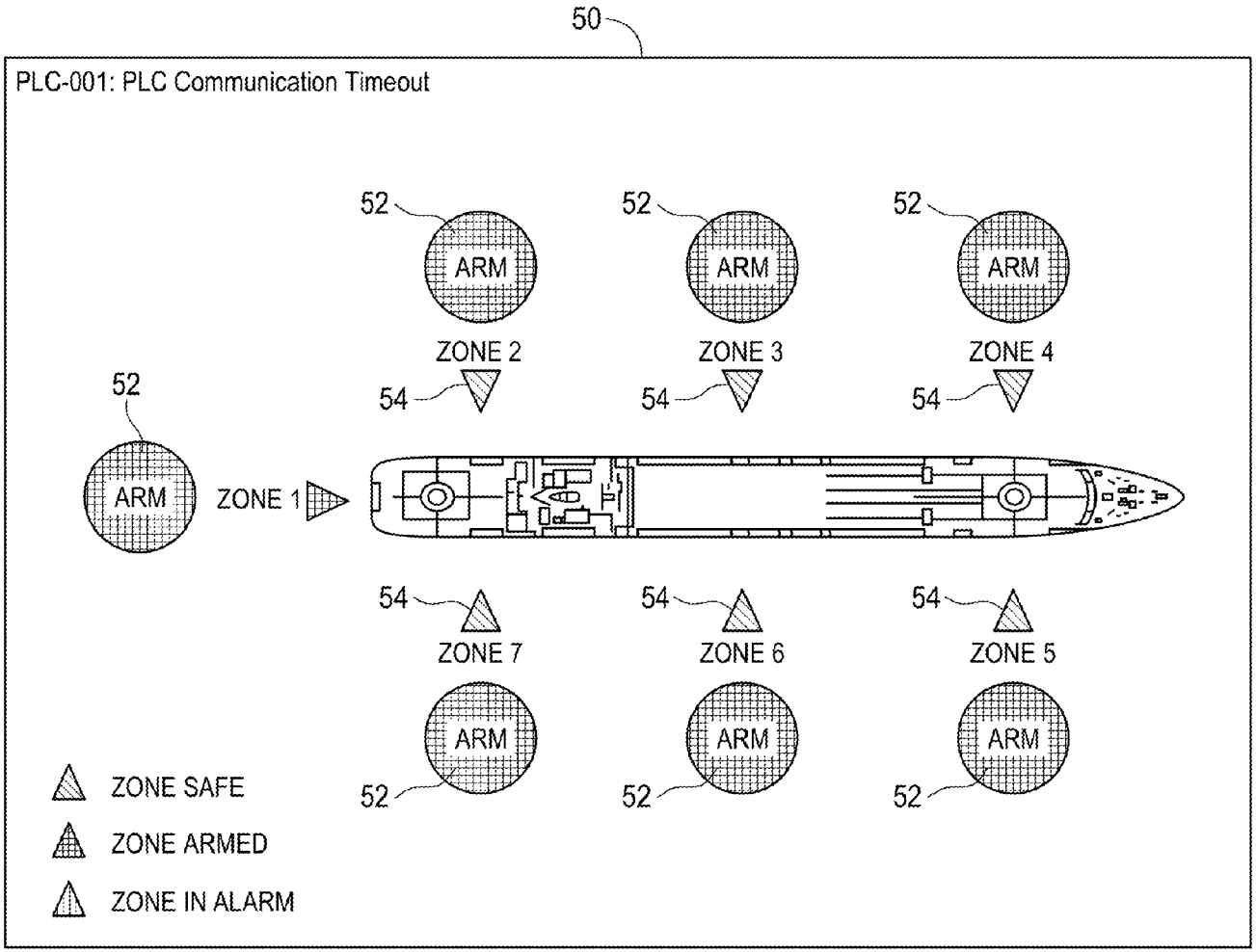
FIG. 5 illustrates a touch screen monitor and controller of a preferred embodiment system of the invention.

FIG. 5 shows a touch screen monitor 50 in the control/display system 26 of FIG. 2. In this example, the system is installed on a ship and has seven zones 52 for detection and deterrence response. Status indications 54 are provided for each of the zones 52, which can be independently or jointly set to different modes. Mode menus can be accessed by selecting a zone or the entire ship system to set a mode of operation.

The system 10 preferably has three modes: Active, Passive, and Emergency. Active mode is a mode when the system is set to detect motion at the gunwale or base, such as a boarding hook or rope placement and initiate the alarm. In this mode, for example, the device would sound for ten (10) minutes before resetting itself. If the IR beam remains broken or were broken again within thirty (30) minutes, the alarm would remain on until it is manually de-activated. Passive mode occurs when the system 10 must be shut down in order to facilitate work around the hull of the vessel. Emergency mode occurs if the system is passive in a zone and a boarding is witnessed in that zone or when personnel recognize a threat prior to detection by the virtual fence. Strategically placed, key activated panic buttons can be placed throughout a vessel that has the system 10 installed.

The system 10 can operate continuously and independently of human interaction after being activated. The monitoring and control system 26 displays information through the monitor 50 about the status of the detection and deterrence devices and permits a user to configure the system by zones and operational modes to permit commercial operations while also protecting the maritime asset.

Remote control activators can also be part of the system 10 and would preferably be issued to key members of the crew i.e., Master, First Mate and Chief Engineer. The remote controls also have the capability to de-activate the system when the situation warrants. The deterrence pod 16 and fence pod 20 devices also preferably have an "Anti-Tamper" feature that activates the entire system 10 if tampered with in any zone, such as when the system 10 detects that an electrical connection to a deterrence pod 16 or fence pod 20 is interrupted. The system remains active until manually de-activated by key crewmembers. Visual indicators of an active system, in the form of flashing red lights, can be placed in strategic positions throughout the maritime asset, depending on asset size. Typical positions are: The Bridge, Control Center, Masters Cabin, Chow Halls, Engine Control Room, Rig work areas, Crew Break Areas.

Systems of the invention can automatically protect an asset from the waterline to the deck. Initial deterrent responses and continued deterrent responses can proceed automatically. This frees crew to perform other tasks, and requires no additional manpower to achieve monitoring and deterrence. Automatic deterrence response coupled with crew notification provides a system that is effective and inexpensive to operate. The system can operate 24 hours a day, 365 days a year and provide 360 degree protection around an asset or a vessel when the vessel is in transit, port or at anchor. The system positively identifies a threat without need for algorithmic computer support or crew intervention.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. An active automated anti-boarding maritime asset security system, comprising:

detection devices configured to mount to maritime assets, the detection devices each including emitters and receivers for generating and detection beams that form a virtual fence to form a detection network on a portion or around an entire maritime asset;

deterrence devices responsive to the interruption of the spaced apart detection beams that produce a human deterrence response that is non-lethal;

wherein each of the deterrence devices comprises a housing, a plurality of visible laser light emitters disposed on the housing, and a plurality of sound emitters disposed on the housing; and further comprising a monitoring and control system that displays information about the status of the detection and deterrence devices and permits a user to configure the system by zones and operational modes to permit commercial operations while also protecting the maritime asset.

2. The system of claim 1, wherein the monitoring and control system includes a graphical display that identifies zones of the maritime asset.

3. The system of claim 1, wherein the monitoring and control system activates the deterrence response of all zones when tampering is detected.

* * * * *